US008851589B2

(12) United States Patent
Gwak

(10) Patent No.: US 8,851,589 B2
(45) Date of Patent: Oct. 7, 2014

(54) REFRIGERATOR INCLUDES AN AUXILIARY SHELF FOLDED BY CONTACTING A SHELF GUIDE ON A BACK SURFACE OF A SECOND DOOR

(71) Applicant: LG Electronics Inc., Seoul (KR)

(72) Inventor: Younghoon Gwak, Gyeongsangnam-do (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 13/670,996

(22) Filed: Nov. 7, 2012

(65) Prior Publication Data

US 2013/0119849 A1 May 16, 2013

(30) Foreign Application Priority Data

Nov. 11, 2011 (KR) ..... 10-2011-0117326

(51) Int. Cl.

| | |
|---|---|
| ***F25D 23/04*** | (2006.01) |
| ***F25D 23/02*** | (2006.01) |
| ***F25D 25/02*** | (2006.01) |
| ***A47B 96/16*** | (2006.01) |

(52) U.S. Cl.

CPC ..... *F25D 23/04* (2013.01); *F25D 23/025* (2013.01); *F25D 25/027* (2013.01); *F25D 2323/023* (2013.01); *A47B 96/16* (2013.01)

USPC ..... 312/405.1; 312/292

(58) Field of Classification Search

CPC ..... A47B 96/04; A47B 96/14; A47B 77/00; A47B 77/10; A47B 46/00; A47B 95/00; A47B 49/00; A47B 88/00; A47B 96/16; F25D 25/025; F25D 25/02; F25D 25/027; F25D 11/00; F25D 3/02; E06B 1/00

USPC ..... 312/405, 405.1, 291–292, 321.5, 312/313–316, 325–329

See application file for complete search history.

(56) References Cited

U.S. PATENT DOCUMENTS

| | | | | |
|---|---|---|---|---|
| 1,350,503 | A * | 8/1920 | Irvine | 312/315 |
| 1,670,959 | A * | 5/1928 | Grayson | 62/459 |
| 2,095,811 | A * | 10/1937 | Goulooze | 312/274 |
| 2,112,771 | A * | 3/1938 | Goulooze | 312/275 |
| 2,118,735 | A * | 5/1938 | Money | 62/329 |
| 2,122,501 | A * | 7/1938 | Thomas | 312/242 |
| 2,124,857 | A * | 7/1938 | MacGrath | 312/313 |

(Continued)

FOREIGN PATENT DOCUMENTS

| | | |
|---|---|---|
| EP | 2 159 522 A1 | 3/2010 |
| JP | S 50-62160 U | 8/1993 |

(Continued)

OTHER PUBLICATIONS

European Search Report dated May 2, 2014 for Application No. EP12007486, 7 pages.

*Primary Examiner* — Darnell Jayne
*Assistant Examiner* — Ryan A Doyle
(74) *Attorney, Agent, or Firm* — Fish & Richardson P.C.

(57) ABSTRACT

A refrigerator includes an auxiliary shelf unfolded by being linked with an opening/closing of a second door which opens or closes a storage space defined in a first door. The second door covers the storage space and is rotated in the same direction as the first door.

17 Claims, 6 Drawing Sheets

(56) References Cited

U.S. PATENT DOCUMENTS

| | | | | |
|---|---|---|---|---|
| 2,381,598 | A * | 8/1945 | Jones | 312/291 |
| 3,045,746 | A * | 7/1962 | Kummerman | 160/206 |
| 4,087,140 | A * | 5/1978 | Linstromberg | 312/292 |
| 5,546,773 | A * | 8/1996 | Lee | 68/196 |
| 5,857,363 | A * | 1/1999 | Jung et al. | 68/196 |
| 5,860,717 | A * | 1/1999 | Mizrahi | 312/322 |
| 6,401,478 | B2 * | 6/2002 | Dasher et al. | 62/344 |
| 6,484,529 | B2 * | 11/2002 | Dasher et al. | 62/344 |
| 6,779,858 | B2 * | 8/2004 | Mizrahi | 312/330.1 |
| 7,246,866 | B2 * | 7/2007 | Mizrahi | 312/330.1 |
| 8,752,916 | B2 * | 6/2014 | Kwon et al. | 312/292 |
| 2001/0037657 | A1 | 11/2001 | Dasher et al. | |
| 2009/0261701 | A1 * | 10/2009 | Yun et al. | 312/405 |
| 2010/0308705 | A1 * | 12/2010 | Kwon et al. | 312/404 |
| 2012/0062093 | A1 * | 3/2012 | Lee et al. | 312/405 |
| 2013/0081423 | A1 * | 4/2013 | Kwon et al. | 62/449 |
| 2013/0342095 | A1 * | 12/2013 | Choo et al. | 312/405 |

FOREIGN PATENT DOCUMENTS

| | | | | |
|---|---|---|---|---|
| KR | 2005-0071221 | A | 7/2005 | |
| KR | 2006-0015146 | A | 2/2006 | |
| KR | 2009-001784 | U | 2/2009 | |
| WO | WO 2010131813 | A1 * | 11/2010 | F25D 23/02 |

* cited by examiner

REFRIGERATOR INCLUDES AN AUXILIARY SHELF FOLDED BY CONTACTING A SHELF GUIDE ON A BACK SURFACE OF A SECOND DOOR

CROSS-REFERENCE TO RELATED APPLICATIONS

The present application claims priority under 35 U.S.C. 119 and 35 U.S.C. 365 to Korean Patent Application No. 10-2011-0117326 (Nov. 11, 2011), which is hereby incorporated by reference in its entirety.

FIELD

The present disclosure relates to a refrigerator.

BACKGROUND

In general, refrigerators are home appliances for storing foods at a low temperature in an inner storage space covered by a door. For this, such a refrigerator cools an inner storage space using cool air generated through heat-exchange with a refrigerant circulating in a refrigeration cycle.

SUMMARY

In one aspect, a refrigerator includes a cabinet defining a storage space and a first door rotatably mounted on the cabinet. The first door is configured to open and close at least a portion of the storage space and defines an opening through the first door. The refrigerator also includes a second door that is configured to open and close the opening by rotating in a same direction as the first door and an auxiliary shelf that has both sides shaft-coupled to the opening. The auxiliary shelf contacts a back surface of the second door, is unfolded in a direction crossing a rotation direction of the second door based on the second door opening, and is folded in the direction crossing the rotation direction of the second door based on the second door closing.

Implementations may include one or more of the following features. For example, the auxiliary shelf may include a main plate rotatably mounted on the opening and a sub plate disposed on a front side of the main plate and configured to selectively contact the back surface of the second door. In this example, the auxiliary shelf may include a connection member that connects the main plate to the sub plate and that allows the sub plate to rotate relative to the main plate.

In some implementations, a bottom surface of the sub plate may include a horizontal part that extends horizontally from a rear end of the sub plate. The rear end of the sub plate may be an end of the sub plate that is closest to the main plate. In these implementations, a bottom surface of the sub plate also may include an inclined part that extends upward in an inclined manner from a front end of the horizontal part and that is configured to contact the second door based on the second door closing.

In some examples, the refrigerator may include a roller that is disposed on a bottom surface of the auxiliary shelf and that contacts the back surface of the second door based on the second door closing. In these examples, the roller may be included in a plurality rollers that are disposed on the bottom surface of the auxiliary shelf and that are spaced apart a predetermined distance in a horizontal direction.

In some implementations, the refrigerator may include a shelf guide that is disposed on the back surface of the second door, that protrudes from the back surface of the second door to contact the auxiliary shelf based on the second door closing, and that has an inclined surface configured to guide rotation of the auxiliary shelf. In these implementations, the shelf guide may include a first inclined part that protrudes from the back surface of the second door and that has an inclined surface that extends upward in an inclined manner relative to the auxiliary shelf and a second inclined part that extends upward from an upper end of the first inclined part. The second inclined part may have an inclination less than that of the first inclined part.

In addition, an end of the first inclined part may be disposed below a front end of the auxiliary shelf. Also, the refrigerator may include a guide roller that is disposed on a front end of the sub plate at a position corresponding to the shelf guide and that contacts the shelf guide based on the second door closing. The guide roller may be configured to contact the first inclined part in a state where the auxiliary shelf is unfolded.

In some examples, the sub plate may define a guide hole through which the connection member passes. In these examples, the guide hole may have a vertical length greater than that of the connection member, thereby allowing the sub plate to be independently rotated with respect to the main plate.

Front and rear ends of the connection member may be rotatably connected to the main plate and the sub plate, respectively. The connection member may be inserted into the main plate and the sub plate and the main plate and the sub plate may be maintained in contact with each other.

The refrigerator may include an accommodation device that is disposed at a back surface of the first door and that defines an accommodation space accessible through the opening. The refrigerator also may include a damping member that is disposed on a side of the main plate or the opening, that is connected to a rotation shaft of the main plate, and that damps rotation of the auxiliary shelf.

In some implementations, the auxiliary shelf may extend out from the opening when the second door is opened. In these implementations, the auxiliary shelf may be positioned within the opening when the second door is closed.

Further, the auxiliary shelf may have a rotational shaft that enables rotation of the auxiliary shelf and that is perpendicular to a rotational shaft of the second door and a rotational shaft of the first door. A shape of the second door may correspond to a shape of the first door such that a width of the second door is substantially equal to a width of the first door. The second door may align with an uppermost edge of the first door when the second door is closed.

In some examples, a first depth of a first part of the first door may be narrower than a second depth of a second part of the first door and a stepped portion of the first door may be located where the first door changes from the first depth to the second depth. In these examples, the second door may be located at the first part of the first door that has the first depth.

The details of one or more implementations are set forth in the accompanying drawings and the description below. Other features will be apparent from the description and drawings, and from the claims.

DETAILED DESCRIPTION

Figure 1:
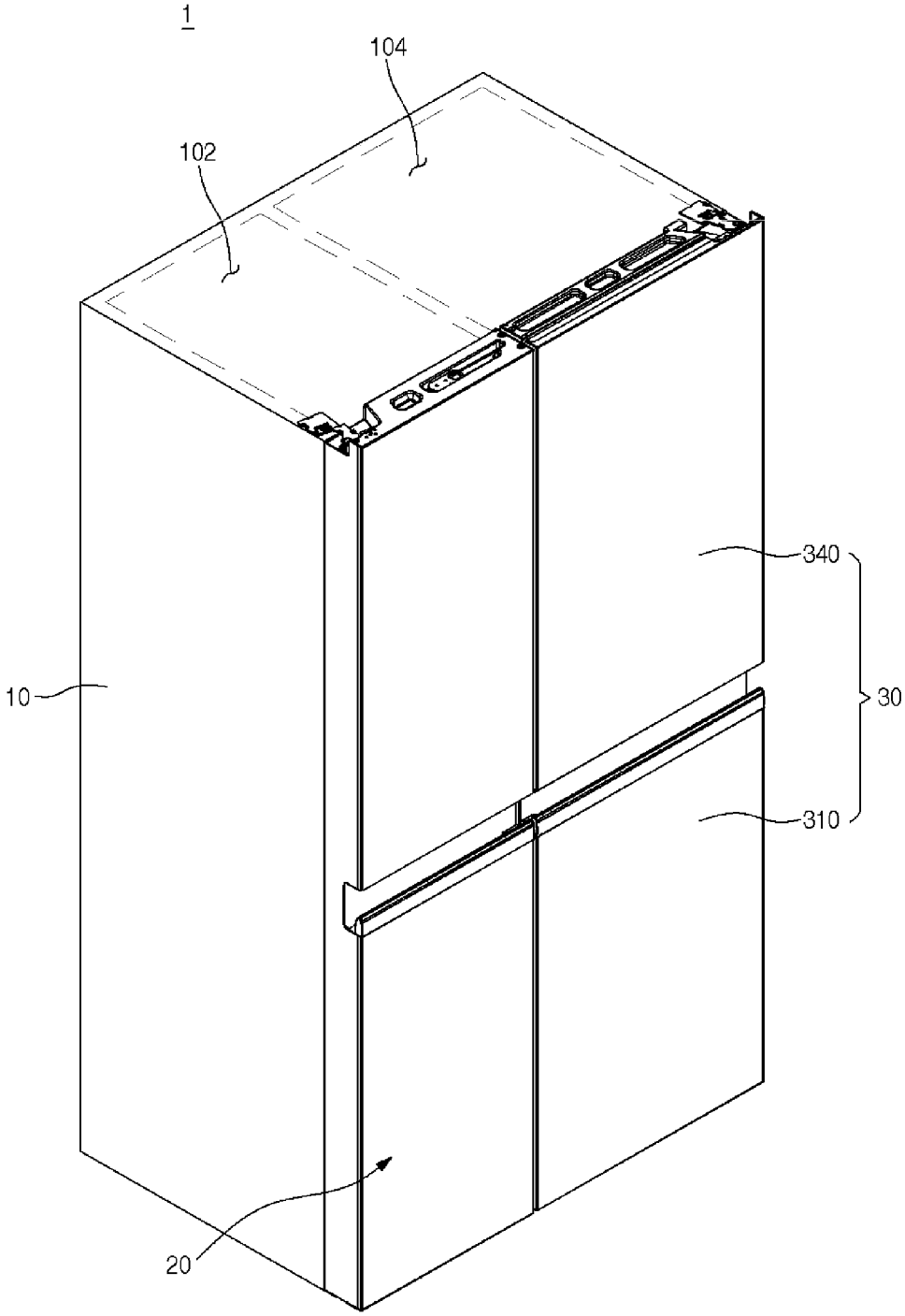
FIG. 1 is a perspective view of an example refrigerator.
Figure 2:
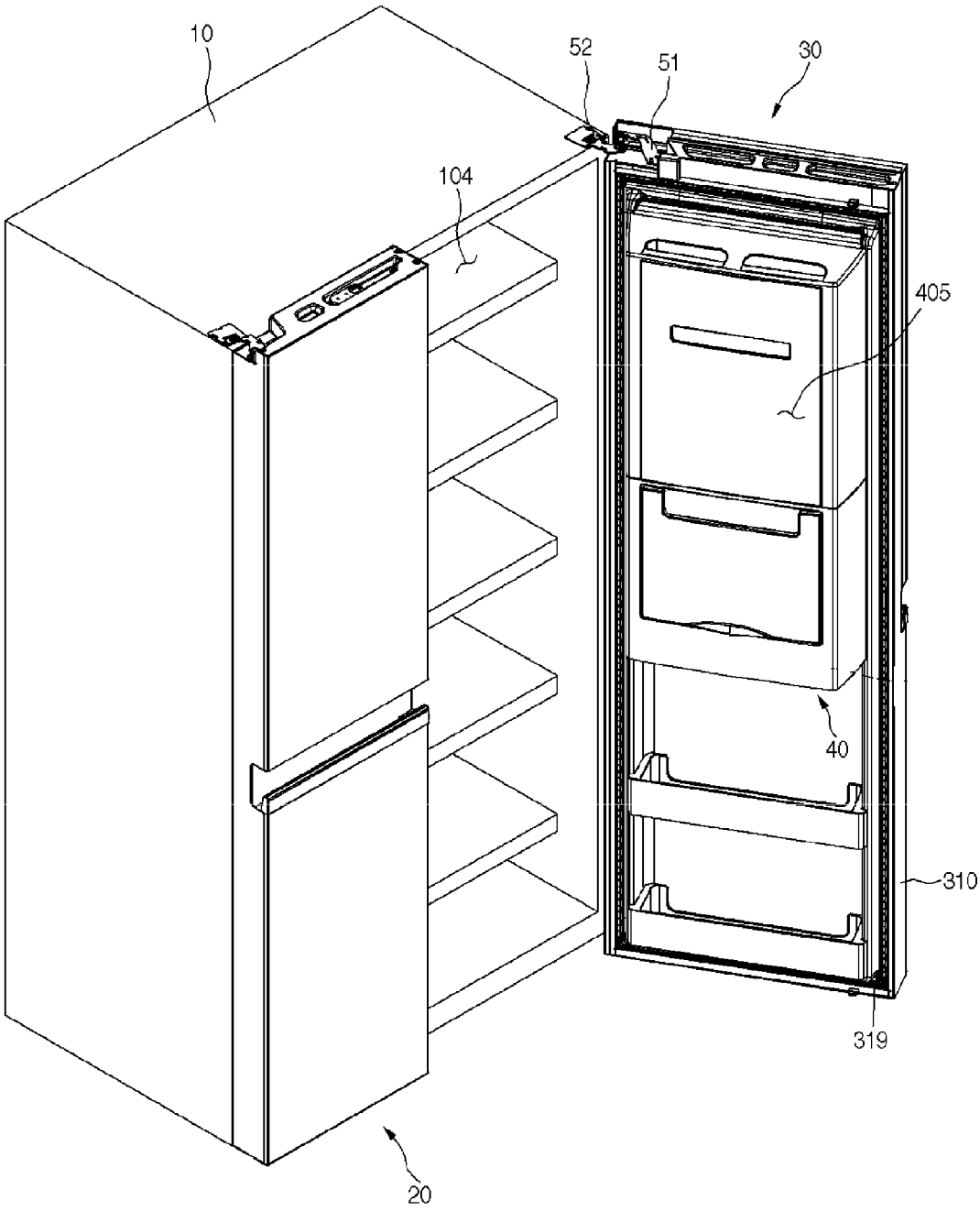
FIG. 2 is a perspective view of the example refrigerator with a first door opened.
Figure 3:
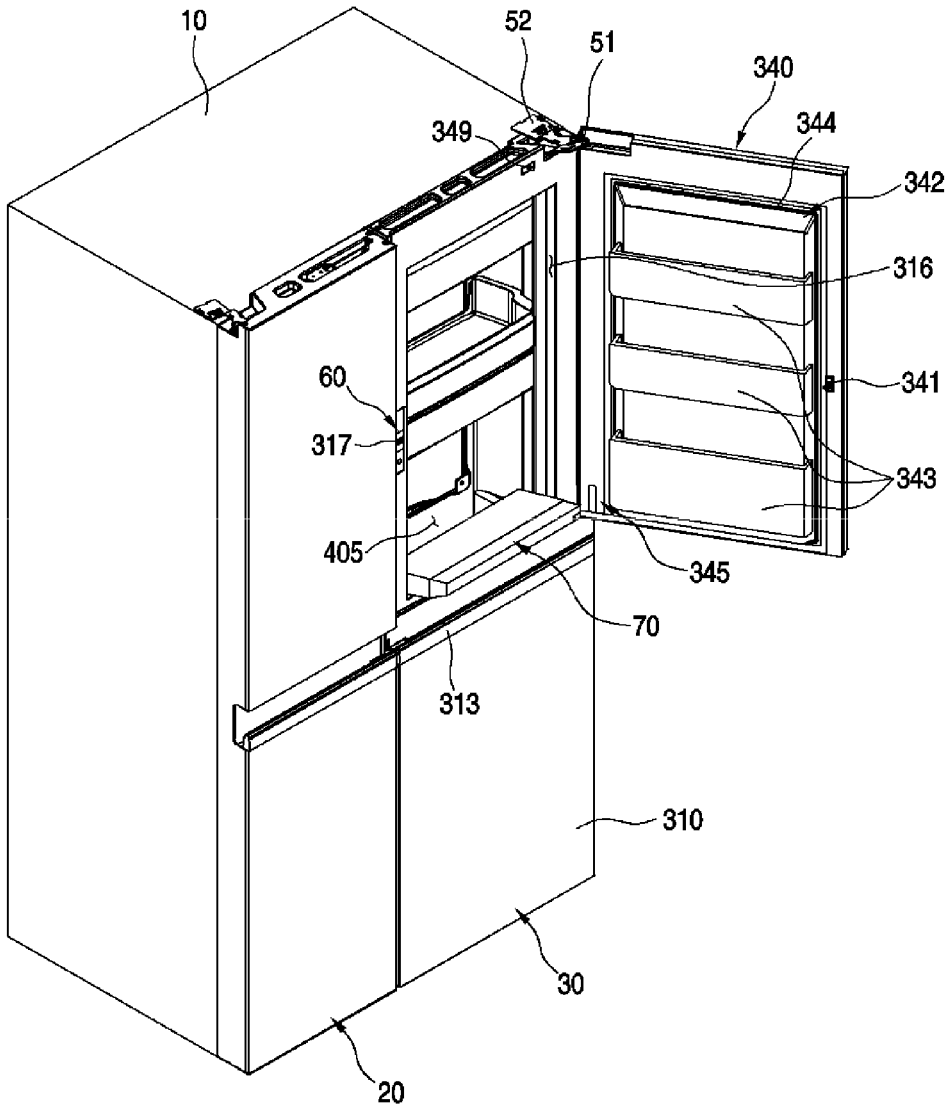
FIG. 3 is a perspective view of the example refrigerator with a second door opened.

FIG. 1 illustrates an example refrigerator. FIG. 2 illustrates the example refrigerator with a first door opened. FIG. 3 illustrates the example refrigerator with a second door opened. For convenience, a side-by-side type refrigerator is described with respect to FIGS. 1-3. However, the present disclosure is not limited thereto. For example, the present disclosure may be applied to all types of refrigerators including a door that is opened or closed by rotation.

Referring to FIGS. 1 to 3, a refrigerator 1 includes a cabinet 10 defining a storage space and doors 20 and 30 for opening or closing the storage space. Here, an outer appearance of the refrigerator 1 may be defined by the cabinet 10 and the doors 20 and 30.

The inside of the cabinet 10 is partitioned in left and right parts to define a freezing compartment 102 and a refrigerating compartment 104, respectively. Also, the doors 20 and 30 may include a freezing compartment door 20 for covering the freezing compartment 102 and a refrigerating compartment door 30 for covering the refrigerating compartment 104.

Also, an accommodation device 40 defining a separate space separated from the inside of the refrigerating compartment 104 may be disposed in the refrigerating compartment door 30. Thus, when the refrigerating compartment door 30 is closed, the inside of the refrigerating compartment 104 may be defined as a first storage compartment, and the inside of the accommodation device 40 may be defined as a second storage compartment 405.

The refrigerating compartment door 30 may include a first door 310 for opening or closing the first storage compartment 104 and a second door 340 for opening or closing the second storage compartment 405.

An upper end of the first door 310 is connected to a top surface of the cabinet 10 by a door hinge 52. Also, the first door 310 may be rotatably coupled to the cabinet 10. Although not shown in detail, a separate hinge may be disposed on a lower end of the first door 310 so that the first door 310 is rotatably mounted. Thus, the first door 310 may be rotated to open or close the refrigerating compartment 104. That is, the first door 310 may be rotated to accommodate foods into the refrigerating compartment 104.

Also, an opening 316 is defined in an upper portion of the first door 310. The opening 316 may extend from a grip part 313 up to a position adjacent to the upper end of the first door 310. Also, the opening 316 may extend up to positions adjacent to both left and right ends of the first door 310. Also, the accommodation device 40 may be disposed on a back surface of the first door 310 corresponding to a rear side of the opening 316. The accommodation device 40 has a forwardly opened shape. Thus, an access into the accommodation device 40 may be enabled through the opening 316.

A sealer 319 contacting a circumference of a front surface of the cabinet 10 when the first door is closed is disposed on a circumference of the back surface of the first door 310. The sealer 319 may be formed of an electrically deformable material and thus be compressible. Also, a magnet may be disposed within the sealer 319 so that the sealer 319 is closely attached to the cabinet 10.

Also, the opening 316 through which foods accommodated within the accommodation device 40 are withdrawable in a state where the first door 310 is closed is defined in the refrigerating compartment door 30. Thus, the opening 316 may be opened in a state where the first door 310 covers the refrigerating compartment 104 to take the foods in or out of the accommodation device 40.

The opening 316 may have a size corresponding to a front surface of the accommodation device 40. The opening 316 may be vertically defined over a position of the grip part 313 of the first door 310 and horizontally defined up to a region except for portions of both left and right ends of the first door 310. Thus, the home bar in the example refrigerator may have a size and usability enhanced from that of a home bar used in a general refrigerator.

The grip part 313 is configured to open or close the refrigerating compartment door 30. The grip part 313 is lengthily disposed in a horizontal direction on a center of the refrigerating compartment door 30 corresponding to a boundary between the first door 310 and the second door 340. The grip part 313 may be disposed on a position which can be easily grasped by a user. Also, the grip part 313 may form a boundary portion of lower ends of the opening 316 and the second door 340 to hide an existence of the second door 340.

The grip part 313 may have an inwardly recessed shape. Also, the inside of the grip part 313 may be a downwardly recessed shape so that the user easily grasps the grip part 313. The grip part 313 may be applied to the freezing compartment door 20 in the same shape as that of the refrigerating compartment door 30. When viewed from a front side, a left end and a right end of the grip part 313 may have the same height. Thus, although the second door 340 is disposed on the refrigerating compartment door 30, when viewed from the front side, the refrigerating compartment door 30 and the freezing compartment door 20 may appear to be uniform.

The second door 340 is configured to open or close the opening 316. The second door 340 is rotatably mounted on the first door 310 by an upper hinge 51. The upper hinge 51 has a structure in which both ends of the upper hinge 51 are respectively shaft-coupled to a top surface of the first door 310 and a top surface of the second door 340 so that the second door 340 is rotated using the first door as a shaft.

A lower hinge is further disposed on a lower end of the second door 340. The lower hinge is disposed between the lower end of the second door 340 and the opening 316 to rotatably support the second door 340. The lower hinge may have a cam structure or a spring structure. Thus, the second door 340 may be more smoothly opened or closed.

Also, the first door 310 and the second door 340 may be independently rotated. Thus, the first door 310 and the second door 340 may be independently manipulated to selectively open or close the refrigerating compartment 104 and the opening 316.

A front surface of the second door 340 may be formed of the same material as those of the first door 310 and the refrigerating compartment door 20 to provide a continuous design or pattern. Also, the front surface of the second door 340 may be flush with that of the refrigerating compartment door 30 below the second door 340 in a state where the second door 340 is closed.

Also, the upper end and both left and right ends of the second door 340 are disposed at the same position as those of the refrigerating compartment door 30 in the state where the second door 340 is closed. The lower end of the second door 340 may extend up to a position corresponding to a region in which the grip part 313 of the refrigerating compartment door 30 is disposed. That is, the lower end of the second door 340 may extend up to a position corresponding to a stepped portion of the region in which the grip part 313 of the freezing compartment door 20 is disposed. Thus, in the state where the second door 340 is closed, the second door 340 may be integrated with the first door 310. When viewed from the front side, sense of unity may be provided so that connection portions on which the second door 340 is disposed are not seen.

Thus, in a state where the first door 310 and the second door 340 are closed, when viewed from the front side, the refrigerating compartment door 30 and the freezing compartment door 20 may be seen in the same shape. A person who had never seen the refrigerator before does not easily recognize the second door 340. That is, the person may recognize the first and second doors 310 and 340 as one door.

A protrusion 342 protruding inward may be disposed on the back surface of the second door 340. A portion of the back surface of the second door 340 protrudes to form the protrusion 342. Also, the protrusion 342 protrudes in a shape corresponding to that of the opening 316. Thus, in the state where the second door 340 is closed, the protrusion 342 is disposed inside the opening 316. Also, the protrusion 342 may be engaged with the opening 316 to reduce (e.g., prevent) leakage of cool air.

An accommodation part 343 for accommodating foods is disposed on the protrusion 342. The accommodation part 343 may be disposed inward, and also, a separate basket may be attached to the accommodation part 343 to form a pocket shape.

Also, a gasket 344 is disposed along a circumference of the protrusion 342. The gasket 344 may be formed of an elastically deformable material such as rubber or silicon. When the second door 340 is closed, the gasket 344 may be closely attached to the front surface of the refrigerating compartment door 30. Here, the gasket 344 may be in a pressed state to reduce (e.g., prevent) leakage of cool air from within the accommodation device 40.

A second door switch 349 for detecting an opening/closing of the second door 340 is disposed on an upper end of the refrigerating compartment door 30. The second door switch 349 may be configured to output an alarm signal to the outside when the second door 340 is not closed.

Also, a locking unit 60 may be disposed on a side end of the back surface of the second door 340 away from a rotation shaft of the second door 340 and a side end of the refrigerating compartment door 30 corresponding to the side end of the back surface of the second door 340. The locking unit 60 may maintain a state in which the second door 340 is closed. Also, the restraint and release of the locking unit 60 may be selectively switched by a push manipulation to selectively restrain the second door 340.

The locking unit 60 may have the same structure as a general push switch. The locking unit 60 may include a locking device mounted on a side of the refrigerating compartment door 30 and including a latch slot 317 in which a latch hook 341 is inserted and the latch hook 341 disposed on the second door 340. The locking unit 60 may have a structure which is used in a general refrigerator.

An auxiliary shelf 70 may be further disposed on a lower end of the opening 316. The auxiliary shelf 70 may be rotatably mounted on the opening 316. When the second door 340 is closed, the auxiliary shelf 70 may be rotated and folded. Also, when the second door 340 is opened, the auxiliary shelf 70 may be rotated and unfolded. The auxiliary shelf 70 may have a length corresponding to a horizontal width of the opening 316. When the auxiliary shelf 70 is unfolded, the auxiliary shelf 70 may have a width which protrudes forward by a predetermined length from the opening 316 to place foods thereon.

Figure 4:
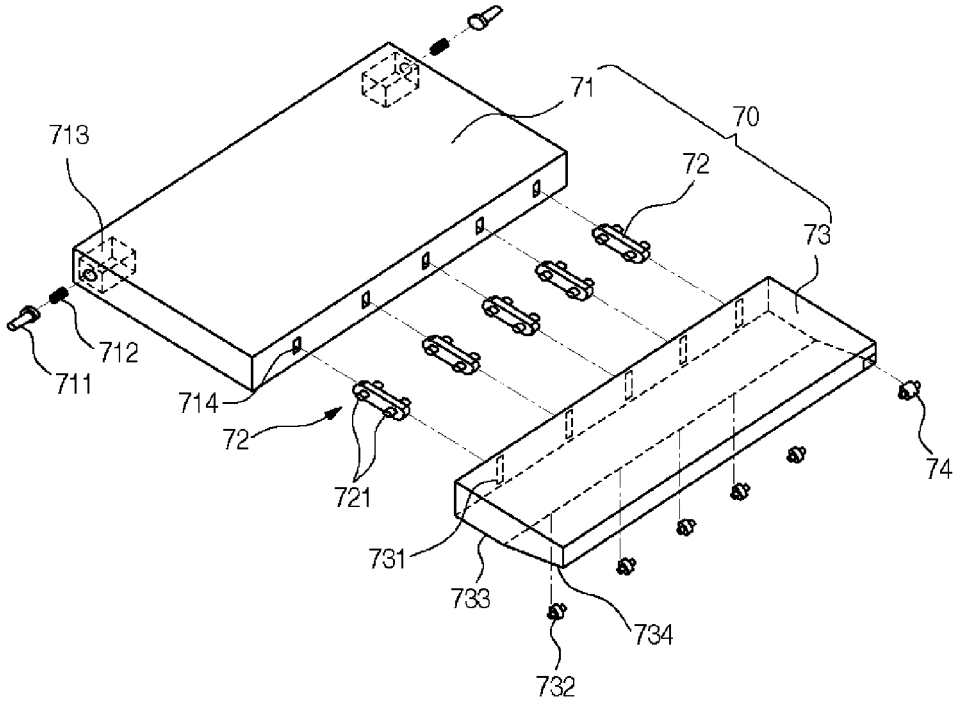
FIG. 4 is an exploded perspective view of an example auxiliary shelf.
Figure 5:
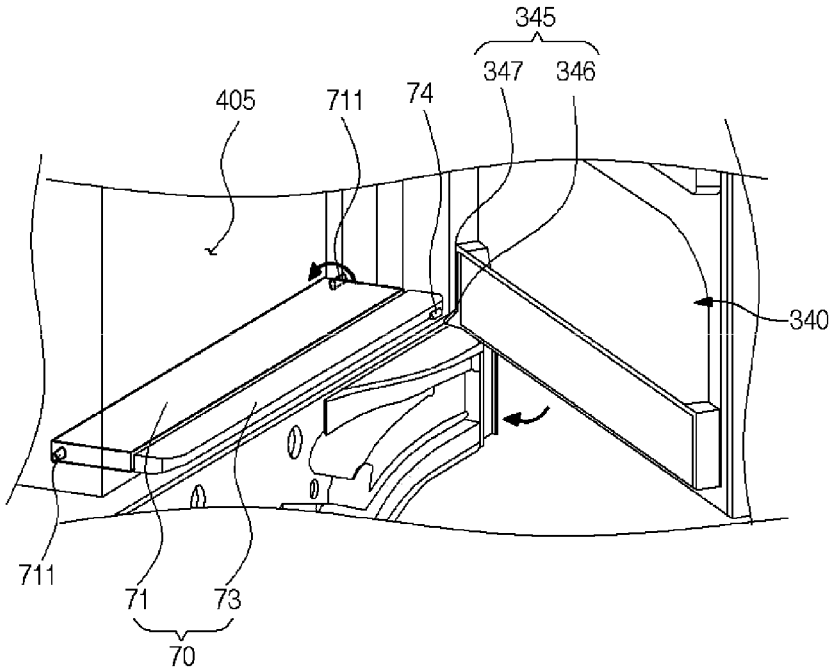
FIGS. 5 and 6 are views illustrating operation of the example auxiliary shelf according to an opening/closing of the second door.
Figure 6:
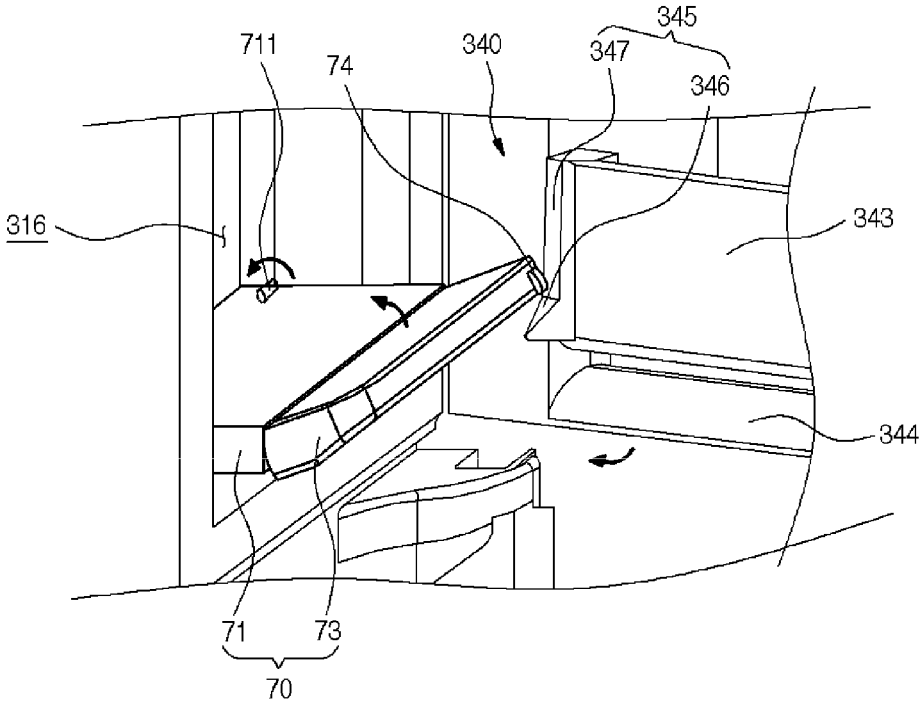
Figure 7:
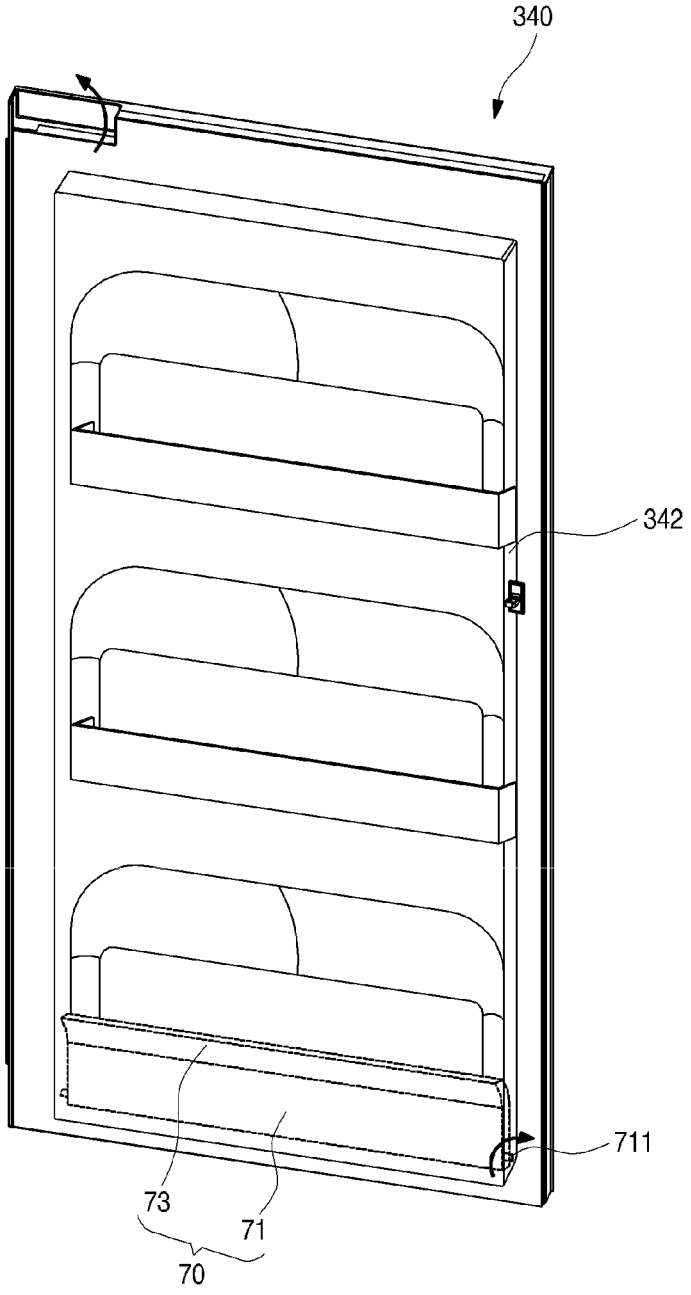
FIG. 7 is a view illustrating a state of the example auxiliary shelf when the second door is closed.

FIG. 4 illustrates an example auxiliary shelf. FIGS. 5 and 6 illustrate operation of the example auxiliary shelf according to an opening/closing of the second door. FIG. 7 illustrates a state of the example auxiliary shelf when the second door is closed.

Referring to FIGS. 4 to 7, the auxiliary shelf 70 may include a main plate 71 and a sub plate 73. The main plate 71 may have a length corresponding to a horizontal width of the opening 316. Also, the main plate 71 may have a square plate shape.

A rotation shaft 711 of the main plate 71 is disposed on each of both left and right surfaces of the main plate 71, respectively. The rotation shaft 711 may be axially moved and supported by an elastic member 712. Thus, the rotation shaft 711 may be moved to mount or separate the main plate 71 on/from the opening 316.

A damping member 713 may be further disposed on each of both sides of the main plate 71 or the opening 316. The damping member 713 may be coupled to the rotation shaft 711. Alternatively, the rotation shaft 711 may constitute a portion of the damping member 713. Thus, the rotation shaft 711 may be configured to allow the auxiliary shelf 70 to be more smoothly rotated and folded. Also, the rotation shaft 711 may restrict the rotation of the auxiliary shelf 70 to blocks the auxiliary shelf 70 from being reversely rotated, e.g., further rotated toward the storage space with respect to a vertical state thereof.

The sub plate 73 is disposed on a front side of the main plate 71. The sub plate 73 may have a size corresponding to a horizontal width of the main plate 71. Also, the sub plate 73 is rotatably connected to the main plate 71 by a connection member 72.

In more detail, the main plate 71 and the sub plate 73 are connected to each other by the connection member 72. The connection member 72 may be provided in plurality along a horizontal direction at a predetermined distance. Thus, the sub plate 73 may be rotated in a counterclockwise direction (when viewed in FIG. 5). Coupling shafts 721 protruding in both left and right directions are disposed on front and rear ends of the connection member 72. The coupling shafts 721 are shaft-coupled to the insides of the main plate 71 and the sub plate 73, respectively.

Also, an insertion hole 714 is defined in a front end of the main plate 71. A rear end of the connection member 72 is inserted into the insertion hole 714. Also, a guide hole 731 having a length greater than that of the connection member 72 is defined in a rear end of the sub plate 73. Thus, when the sub plate 73 is rotated, the sub plate 73 does not interfere with the connection member 72.

A plurality of rollers 732 may be disposed on a bottom surface of the sub plate 73. When the second door 340 is closed, the rollers 732 contact the back surface of the second door 340 to more smoothly rotate the auxiliary shelf 70.

That is, if the auxiliary shelf 70 is rotated at an angle greater than a preset angle when the second door 340 is closed, the rollers 732 contact the back surface of the second door 340. Here, the rollers 732 are disposed at positions contacting the second door 340 and rolled along the back surface of the second door 340 to rotate the auxiliary shelf 70 in the counterclockwise direction.

The bottom surface of the sub plate 73 includes a horizontal part 733 and an inclined part 734. The horizontal part 733 is disposed from the rear end of the sub plate 73 up to a predetermined distance. The inclined part 734 is disposed from a front end of the horizontal part 733 up to the front end of the sub plate 73. The inclined part 734 is inclined upward toward a front side. The rollers 732 may be disposed on a boundary between the horizontal part 733 and the inclined part 734. Thus, when the second door 340 is closed, the second door 340 and the inclined part 734 may contact each other to allow the sub plate 73 and the auxiliary shelf 70 to be easily rotated.

A guide roller 74 may be disposed on the front end of the sub plate 73 adjacent to the rotation shaft 711 of the second door 340. The guide roller 74 may be disposed on a right side of the front end of the sub plate 73.

A shelf guide 345 is disposed on the back surface of the second door 340 corresponding to the guide roller 74 when the second door 340 is closed. The shelf guide 345 may contact the auxiliary shelf 70 to allow the auxiliary shelf 70 to be rotated and folded when the second door 340 is closed.

In detail, the shelf guide 345 protrudes inclinedly from a lower portion of the back surface of the second door 340. The shelf guide 345 may include a first inclined part 346 contacting the auxiliary shelf 70 and a second inclined part 347 for further rotating the auxiliary shelf 70. The first inclined part 346 further protrudes downward from the front end of the sub plate 73 to inclinedly extend upward. The first inclined part 346 may further protrude from the second inclined part 347 and be lowered gradually toward the second inclined part 347.

Also, the second inclined part 347 extends upward from an upper end of the first inclined part 346. Also, the second inclined part 347 may have an inclination less than that of the first inclined part 346. When the second door 340 is closed, the second inclined part 347 may contact the auxiliary shelf 70 until the auxiliary shelf 70 is completely vertically disposed.

When the second door 340 is closed, as shown in FIG. 7, the auxiliary shelf 70 is closely attached to the back surface of the second door 340 in a state where the auxiliary shelf 70 is folded. Here, the auxiliary shelf 70 is vertically folded. Also, the auxiliary shelf 70 is not rotated in the state where the auxiliary shelf 70 contacts the second door 340 even though the first door 310 is rotated.

When the second door 340 is closed, the user releases the restraint of the latch hook 341 to open the second door 340. When the restraint of the latch hook 341 is released, the second door 340 is rotated using the upper hinge 51 and the lower hinge as shafts.

Also, when the second door 340 is rotated, the auxiliary shelf 70 is rotated by a self-weight in a clockwise direction (when viewed in FIG. 5). When the second door 340 is fully opened, as shown in FIG. 5, the auxiliary shelf 70 is fully unfolded.

Here, the auxiliary shelf 70 is rotated around the rotation shaft 711. The rotation shaft 711 is disposed at a rear side somewhat than a center of the auxiliary shelf 70. Thus, the auxiliary shelf 70 may be rotated and unfolded by the self-weight. As necessary, the auxiliary shelf 70 may be automatically rotated and unfolded by a spring or damper. Also, the auxiliary shelf 70 may be rotated and unfolded by user's manipulation without using a separate component.

When the second door 340 is fully opened, and the auxiliary shelf 70 is fully unfolded, the user may withdraw foods accommodated in the storage space within the opening 316 and place beverages or cups on the auxiliary shelf 70.

When the foods are completely withdrawn through the opening 316, the second door 340 is closed. When the second door 340 is closed at an angle greater than a preset angle to further rotate the second door 340 as shown in FIG. 5, the first inclined part 346 contacts the guide roller 74. Here, the most protruding portion of the first inclined part 346 is disposed under the guide roller 74, and the guide roller 74 contacts an inclined surface of the first inclined part 346.

In this state, when the second door 340 is further rotated and thus closed, the guide roller 74 is moved along the inclined surface of the first inclined part 346. Then, the sub plate 73 may be smoothly rotated in a counterclockwise direction using the connection member 72 as a shaft.

In this state, when the second door 340 is further closed, the sub plate 73 is further rotated. Thus, as shown in FIG. 6, the guide roller 74 passes through the first inclined part 346 to contact the inclined surface of the second inclined part 347.

When the guide roller 74 passes through the second inclined part 347, the sub plate 73 is not further rotated by interfering with the connection member 72. Thus, in this position, the main plate 71 is rotated around the rotation shaft 711 in the counterclockwise direction, and thus, the whole auxiliary shelf 70 is rotated. In this state, when the second door 340 is further rotated, the auxiliary shelf 70 is further rotated. Here, the rollers 732 contact the back surface of the second door 340 to allow the auxiliary shelf 70 to be more smoothly rotated.

When the second door 340 is fully closed, as shown in FIG. 7, the auxiliary shelf 70 is fully unfolded. Thus, the auxiliary shelf 70 vertically stands up in the state where the auxiliary shelf 70 contacts the back surface of the second door 340.

According to some implementations, the auxiliary shelf may be unfolded by being linked with the opening of the second door. Thus, the user may place foods to be accommodated in the accommodation device on the unfolded auxiliary shelf to easily realize the accommodation of the foods.

Also, the auxiliary shelf may be constituted by the main plate and the sub plate. Thus, the auxiliary shelf may be more smoothly folded or unfolded by being linked with the opening/closing of the second door through the contact of the guide roller and the shelf guide, thereby improving the convenience of use.

Although implementations have been described with reference to a number of illustrative examples thereof, numerous other modifications and implementations can be devised by those skilled in the art that will fall within the spirit and scope of the principles of this disclosure. More particularly, variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator comprising:

a cabinet defining a storage space;

a first door rotatably mounted on the cabinet, the first door being configured to open and close at least a portion of the storage space and defining an opening through the first door;

a second door that is configured to open and close the opening by rotating in a same direction as the first door; and an auxiliary shelf that has both sides shaft-coupled to the opening, the auxiliary shelf contacting a back surface of the second door, being unfolded in a direction crossing a rotation direction of the second door based on the second door opening, and being folded in the direction crossing the rotation direction of the second door based on the second door closing, wherein the auxiliary shelf comprises:

a main plate rotatably mounted on the opening;

a sub plate disposed on a front side of the main plate and configured to selectively contact the back surface of the second door;

a connection member that connects the main plate to the sub plate and that allows the sub plate to rotate relative to the main plate;

a guide roller that is disposed on a front end corner of the sub plate adjacent to a rotation axis of the second door;

a shelf guide that is disposed on the back surface of the second door, that contacts the guide roller when the second door is closed, and that has an inclined surface configured to guide rotation of the auxiliary shelf; and a plurality of rollers that are disposed on a bottom surface of the sub plate and that, when the second door is closed, contact the back surface of the second door to facilitate smooth rotation of the auxiliary shelf, wherein, upon initial rotation of the second door to close the opening, the guide roller moves along the shelf guide causing the sub plate to rotate, and wherein, as the second door is further rotated to close the opening and further rotate the sub plate, the plurality of rollers contact the back surface of the second door and the auxiliary shelf is further rotated.

2. The refrigerator according to claim 1, wherein the bottom surface of the sub plate comprises:

a horizontal part that extends horizontally from a rear end of the sub plate, the rear end of the sub plate being an end of the sub plate that is closest to the main plate; and an inclined part that extends upward in an inclined manner from a front end of the horizontal part and that is configured to contact the second door based on the second door closing.

3. The refrigerator according to claim 2, wherein the plurality of rollers are disposed on a boundary between the horizontal part and the inclined part, and the plurality of rollers are spaced apart a predetermined distance along the boundary.

4. The refrigerator according to claim 1, wherein an accommodation part is provided on the back surface of the second door and the shelf guide is located at a side end of the accommodation part adjacent to the rotation axis of the second door.

5. The refrigerator according to claim 1, wherein the shelf guide comprises:

a first inclined part that protrudes from the back surface of the second door and that has an inclined surface that extends upward in an inclined manner relative to the auxiliary shelf; and a second inclined part that extends upward from an upper end of the first inclined part, the second inclined part having an inclination less than that of the first inclined part.

6. The refrigerator according to claim 5, wherein an end of the first inclined part is disposed below a front end of the auxiliary shelf.

7. The refrigerator according to claim 5, wherein the guide roller is configured to contact the first inclined part in a state where the auxiliary shelf is unfolded.

8. The refrigerator according to claim 1, wherein the sub plate defines a guide hole through which the connection member passes, and the guide hole has a vertical length greater than that of the connection member, thereby allowing the sub plate to be independently rotated with respect to the main plate.

9. The refrigerator according to claim 1, wherein front and rear ends of the connection member are rotatably connected to the main plate and the sub plate, respectively.

10. The refrigerator according to claim 1, wherein the connection member is inserted into the main plate and the sub plate, and the main plate and the sub plate are maintained in contact with each other.

11. The refrigerator according to claim 1, further comprising an accommodation device that is disposed at a back surface of the first door and that defines an accommodation space accessible through the opening.

12. The refrigerator according to claim 1, further comprising a damping member that is disposed on a side of the main plate or the opening, that is connected to a rotation shaft of the main plate, and that damps rotation of the auxiliary shelf.

13. The refrigerator of claim 1, wherein the auxiliary shelf extends out from the opening when the second door is opened, and the auxiliary shelf is positioned within the opening when the second door is closed.

14. The refrigerator of claim 1, wherein the auxiliary shelf has a rotational shaft that enables rotation of the auxiliary shelf and that is perpendicular to a rotational shaft of the second door and a rotational shaft of the first door.

15. The refrigerator of claim 1, wherein a shape of the second door corresponds to a shape of the first door such that a width of the second door is substantially equal to a width of the first door.

16. The refrigerator of claim 1, wherein the second door aligns with an uppermost edge of the first door when the second door is closed.

17. The refrigerator of claim 1:

wherein a first depth of a first part of the first door is narrower than a second depth of a second part of the first door and a stepped portion of the first door is located where the first door changes from the first depth to the second depth; and wherein the second door is located at the first part of the first door that has the first depth.

* * * * *